United States Patent [19]

Koenig et al.

[11] 4,217,994

[45] Aug. 19, 1980

[54] GLUE DISPENSER IN FORM OF A BOTTLE

[75] Inventors: Claus Koenig, Erlangen; Reinhard Koenig, Buckenhof, both of Fed. Rep. of Germany

[73] Assignee: Claus Koenig K.G., Fed. Rep. of Germany

[21] Appl. No.: 789,846

[22] Filed: Apr. 22, 1977

[30] Foreign Application Priority Data

Apr. 23, 1976 [DE] Fed. Rep. of Germany ..... 2617862

[51] Int. Cl.[2] ..... B05C 5/02; B65D 37/00

[52] U.S. Cl. ..... 222/212; 222/501; 401/260; D9/130

[58] Field of Search ..... 222/501, 212, 149, 150, 222/151; 401/260, 264; D9/129, 130

[56] References Cited

U.S. PATENT DOCUMENTS

| | | | |
|---|---|---|---|
| D. 3,428 | 3/1869 | Whitney | D9/129 |
| 2,029,152 | 1/1936 | Bonkowski | 401/186 |
| 2,694,211 | 11/1954 | Warren | 222/501 X |
| 3,062,420 | 11/1962 | Neugut | 222/501 |
| 3,378,330 | 4/1968 | Schwartzman | 222/501 X |
| 3,379,490 | 4/1968 | Schwartzman | 222/501 X |
| 3,405,862 | 10/1968 | Spyra | 229/5.6 |
| 3,416,499 | 12/1968 | Wilmot | 222/422 X |

*Primary Examiner*—F. J. Bartuska

*Attorney, Agent, or Firm*—O'Brien & Marks

[57] ABSTRACT

A glue dispenser in form of a bottle consisting of elastic material with a self-closing valve. A cylindrical rod is movable in a round bore which opens the valve when engaging the object to be provided with the glue. The glue flows through the space between the round bore and the cylindrical rod by pressure on the bottle.

1 Claim, 4 Drawing Figures

GLUE DISPENSER IN FORM OF A BOTTLE

The invention relates to a glue dispenser in the form of a bottle consisting of elastic material with a self-closing valve before the nozzle for the glue.

Such a glue dispenser is known from German Patent Specification 389 452. This glue dispenser consists of a hollow body, for instance of celluloid, which contains liquid glue, and is provided on its one end with an opening which is closed with an applying ball which is pressed from the inside by means of a spring against a ball seat, whereby the ball seat with the fall forms a valve. When the glue dispenser with the ball is passed over an object to be moistened with glue and is pressed against the object, the ball lifts from the ball seat and allows the glue to flow through the opened valve. It has been shown that in such a glue dispenser the nozzle becomes encrusted after application of the dispenser and that, therefore, by use after an intermission the nozzle must be cleaned first, whereby it may easily be damaged. Furthermore this glue dispenser has the disadvantage that the glue portion flowing from it depends always on the pressure of the ball, which leads easily to the formation of glue drops on the object.

It is an object of the invention to design the nozzle in such a way that its disposition to become encrusted is removed and that the glue dispenser is immediately usable also after a long intermission, and also that the flow fo the glue should be independent from the pressure on the object.

This object is achieved by providing a glue dispenser of the above-described type wherein a cylindrical rod is movable in a round bore and ends before a movable valve part on which the cylindrical rod presses, which cylindrical rod opens the valve when engaging the object to be provided or applied with glue and whereby the glue flows through the space between the round bore and the cylindrical rod from the nozzle, limited by that space and portioned by pressure on the bottle by hand.

By this design of the nozzle its cross-sectional area remains the same, independent of the pressure on the cylindrical rod, since the cylindrical sheet-like space does not change. Consequently this space essentially limits the flow of the glue, so that a more or less wide opening of the valve remains without influence on the flow of the glue. To allow the glue to flow through the relatively small cross-section of the cylindrical space only squeezing the bottle is necessary, however, pressure differences are compensated to a large extent by the resistance to the glue flow given by the cylindrical sheet-like space. When the bottle is set down and released after use, the bottle expands on account of its elastically, and air is taken in through the nozzle. This leads automatically to a cleaning of the nozzle from glue so that it may not encrust afterwards. By this handling of the glue dispenser it is also not necessary to compensate the decreasing glue volume by an inlet of air, as this compensation results automatically from the pressing of the bottle by hand.

In a preferred embodiment the nozzle is designed in such a way that it is pointed at the dispenser place and is provided centrally with the round bore, whereby the cylindrical rod presses upon a ball valve which is charged with a spring and which closes the round bore on its inner side. On account of this design the glue dispenser may be placed in different directions upon the object so that practically every handling is possible.

The sealing of the ball valve may be improved by a sealing washer on which the ball is pressed and through which the cylindrical rod extends.

The removing of glue rests from the nozzle after using the glue dispenser may also be supported by providing the bottle with a few, in particular four, longitudinal ribs being spaced by grooves, approximately as wide as a finger, which grooves extend conically in such a way that, when the bottle lies on its ribs, the nozzle is directed upwardly with a slight inclination. If the bottle designed in such a way is placed, for instance, on a table, the glue in the bottle must flow to the rear and leaves the valve free of glue, as the valve lies relatively high. Hereby also a leaking of the glue dispenser on account of a possible leakage of the valve may be prevented.

The invention will be explained hereinafter in greater detail with reference to the following drawings.

Figure 1:
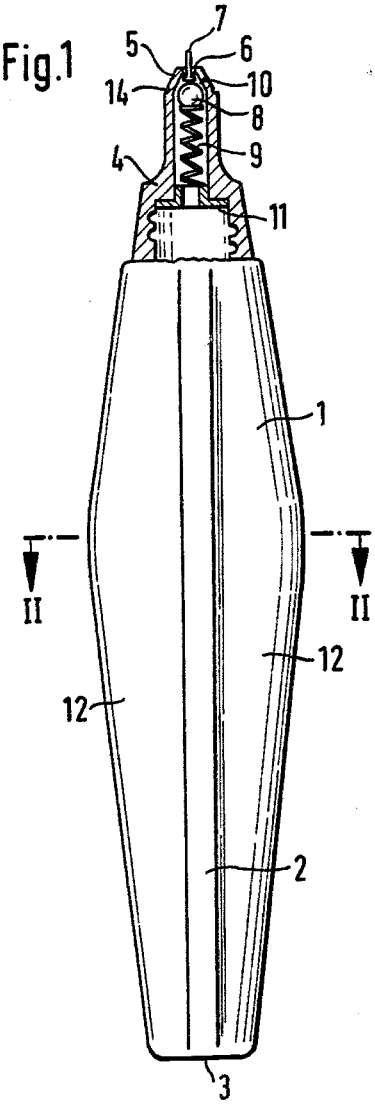
FIG. 1 shows the glue dispenser in upright position.

The glue dispenser shown in FIG. 1 consists of a bottle 1 the wall of which is made of elastic plastic material. The bottle is provided with a plurality of symmetrical ribs between which grooves, approximately as wide as a finger, are located. The bottle has a flat bottom so that the glue dispenser may also be placed upon an object in upright position.

The glue dispenser contains on its upper end a sleeve 4 screwed on the bottle 1. The upper end of the sleeve 4 is in the shape of a cone 5. This cone 5 is provided with an axial round bore 6 in which a cylindrical rod 7 is located. Thus a cylindrical sheet-like space exists between the cylindrical rod 7 and the round bore 6 and through this space the glue may flow out. This will be explained further in the following. The cylindrical rod 7 presses with its rear end against a ball 8 which is lodged against the inner surface 10 of the cone 5 in sleeve 4, by the pressure of a spring 9. The surface 10 and the ball 8 form a ball valve. The spring 9 is supported on its other end by a flange 11.

In using the glue dispenser, the bottle 1 is taken in the hand so that it may easily be compressed. The cylindrical rod 7 is pointed in the direction of the application place and is pressed against it. The cylindrical rod 7 moves in the round bore 6 into the sleeve 4 and moves the ball 8 from the surface 10. The glue contained in the bottle 1 may then flow through the sleeve 4, pass the ball 8 and flow through the space between the cylindrical rod 7 and the round bore 6. It is discharged from the glue dispenser adjacent the front end of cylindrical rod 7, and opposite glue to the application place. Compression of the bottle by hand compensates for a decreasing glue volume in the bottle.

Figure 2:
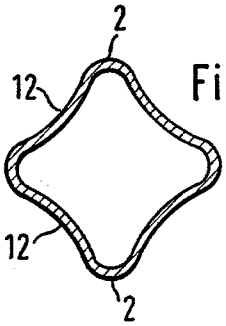
FIG. 2 shows a cross-section of the bottle along the line II—II.

The design of the bottle is further shown in FIG. 2, which is a cross-section along line II—II from FIG. 1. From FIGS. 1 and 2, showing the glue dispenser essentially in real size, it follows clearly that the glue dispenser may be taken in the hand conveniently, whereby the special arrangement of the ribs 2 with the grooves 12 lying between the ribs 2 makes it possible that, if the compressing of the bottle 1 takes place more on the ribs 2 or more on the grooves 12, the glue is discharged from the end of the sleeve 4 at different speeds. Especially by pressure on the ribs 2, the bottle 1 sets a greater resistance against it as by pressure upon the grooves 12 which are, on account of the construction of the bottle, more flexible inwardly than the ribs 2. The grooves 12, approximately as wide as a finger, may be compressed easily with the finger tips.

After termination of the use of the glue dispenser the bottle 1 is released from the hand so that the bottle 1 may expand to its original shape whereby it draws air into the inside of the bottle 1 through the space between the cylindrical rod 7 and the round bore 6. At the same time the application place at the front end of the sleeve 4 will be cleaned from glue.

Figure 3:
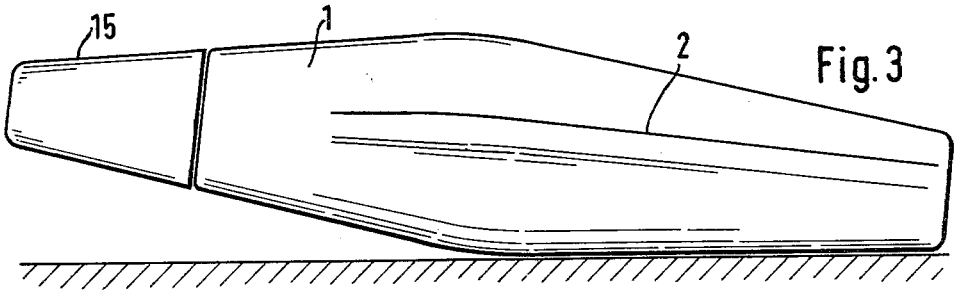
FIG. 3 shows the same glue dispenser placed upon a table.

Because of the shown position of the ribs 2 on the bottle 1 it is achieved that the glue dispenser, as shown in FIG. 3, may also be placed flat on a table without the possibility that the glue dispenser will roll away. The conical arrangement of the ribs 2 insures that the application place with the cylindrical rod 7 is directed so far upwards that, if the glue dispenser is not filled fully, the ball valve is kept free from glue in the inside of the sleeve 4.

Figure 4:
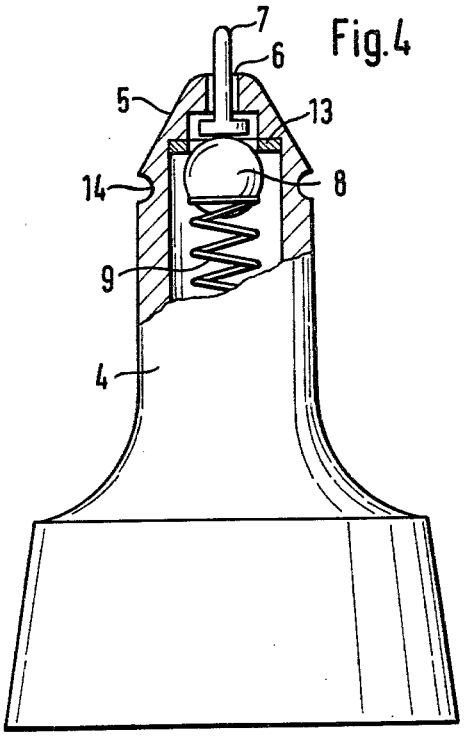
FIG. 4 shows the nozzle in enlarged view.

In FIG. 4 the sleeve 4 is shown in enlarged view. In this construction a sealing washer 13 is placed before the ball 8. This sealing washer 13 consists of elastic material which may not be affected from the liquid glue. By means of this sealing washer 13 an especially good sealing may be obtained. The sleeve 4 contains underneath the cone 5 a groove 14 which serves to hold a cap 15 in position.

What is claimed is:

1. A glue dispenser bottle made of elastic material comprising a body portion adapted to contain a glue supply, a hollow conically shaped applicator tip on one end of said body portion, said body portion being longitudinally tapered in the direction away from said tip and having a plurality of longitudinal ribs on the exterior thereof whereby said bottle when laid on a horizontal surface is prevented from rolling thereon and assumes on orientation wherein said applicator tip is upwardly oriented, a round bore through the apex of the conically shaped applicator tip, a cylindrical rod mounted within said bore for longitudinal movement therein and having an inner end adjacent an inner part of said bore and an outer end protrudable out of an outer part of said bore, said cylindrical rod having a diameter smaller than that of said bore so as to define an annular space therebetween, said annular space defining a flow path through which glue flows, a sealing washer fixed in said tip in alignment with said bore, ball valve means comprising a ball engaging said washer in a closed position, said ball being adjacent the inner end of said rod to contact the same, and a coil compression spring biasing said ball valve means toward the inner end of said rod to a normally closed position, whereby said outer end of said rod may be depressed for moving said ball valve means to an open position against the bias of said spring whereupon glue flows out of said space when the bottle is compressed, and said spring means being such as to produce less force on said ball than pressure difference caused by the elasticity of said bottle whereby air flows back through said space when the bottle is released to clear glue from said space irrespective of the position of said rod.

* * * * *